US005320188A

United States Patent [19]

England

[11] Patent Number: 5,320,188

[45] Date of Patent: Jun. 14, 1994

[54] UNDERGROUND MINING SYSTEM

[76] Inventor: J. Richard England, 1021 Dublin St., Sudbury, Ontario P3A 1R5, Canada

[21] Appl. No.: 932,979

[22] Filed: Aug. 20, 1992

Related U.S. Application Data

[63] Continuation-in-part of Ser. No. 641,770, Jan. 16, 1991, abandoned.

[30] Foreign Application Priority Data

Sep. 5, 1990 [CA] Canada ..... 2024625

[51] Int. Cl.[5] ..... E21B 21/06

[52] U.S. Cl. ..... 175/206; 175/207

[58] Field of Search ..... 175/209, 210, 207, 206, 175/212, 213, 71; 210/533, 535, 304, 307

[56] References Cited

U.S. PATENT DOCUMENTS

| | | | |
|---|---|---|---|
| 2,144,586 | 1/1939 | Kelley . | |
| 2,167,393 | 7/1939 | Muncy . | |
| 3,016,962 | 1/1962 | Lummus et al. | 175/66 |
| 3,417,830 | 12/1968 | Nichols . | |
| 3,566,964 | 3/1971 | Livingston | 166/326 |
| 3,901,332 | 8/1975 | Ebner et al. . | |
| 3,924,696 | 12/1975 | Horlin et al. | 175/213 X |
| 3,968,845 | 7/1976 | Chaffin . | |
| 4,161,222 | 7/1979 | Pye . | |
| 4,223,748 | 9/1980 | Barendsen | 175/209 X |
| 4,284,422 | 8/1981 | Ferland | 175/206 X |
| 4,388,087 | 6/1983 | Tipton . | |
| 4,440,243 | 4/1984 | Howeth | 175/206 X |
| 4,484,643 | 11/1984 | Mahyera et al. | 175/206 |
| 4,516,633 | 5/1985 | Richardson et al. . | |
| 4,839,022 | 6/1989 | Skinner | 175/206 X |

FOREIGN PATENT DOCUMENTS

| | | | |
|---|---|---|---|
| 671325 | 10/1963 | Canada . | |
| 1051866 | 1/1979 | Canada . | |
| 1055475 | 5/1979 | Canada . | |
| 1062245 | 9/1979 | Canada . | |
| 1116102 | 1/1982 | Canada . | |
| 2749633 | 5/1979 | Denmark . | |
| 542826 | 2/1977 | U.S.S.R. . | |
| 1076574 | 2/1984 | U.S.S.R. | 175/207 |

*Primary Examiner*—Hoang C. Dang

*Attorney, Agent, or Firm*—McFadden, Fincham, Marcus & Anissimoff

[57] ABSTRACT

There is disclosed an apparatus and method for drilling underground. The apparatus includes a conventional drilling bit and a shroud disposed around the drill bit to produce a confined for the suspension of drilling debris. The debris is withdrawn under suction from the area by a conduit system associated with the shroud and a cyclonic filter structure.

10 Claims, 14 Drawing Sheets

UNDERGROUND MINING SYSTEM

UNDERGROUND MINING METHOD AND SYSTEM

This application is a continuation-in-part of U.S. application Ser. No. 07/641,770 filed Jan. 16, 1991, now abandoned.

FIELD OF THE INVENTION

The present invention relates to the collection of particulated debris produced during mining or drilling. More particularly, it relates to a method and system for the collection and containment of mining debris produced during underground drilling.

BACKGROUND OF THE INVENTION

In mining procedures using, for example, percussion and rotary drilling apparatus, the production of debris is plentiful and is ejected upwardly through a drill bore hole at a high velocity as a result of air being pumped down the bore hole. The debris generally comprises particulated, fragmented rock and often moisture.

In large mining operations, it is not unusual that several drilling rigs be operating at once, which consequently results in the generation of dust clouds in the working environment. This difficulty is not only deleterious to the health of individuals working in the mining area, but additionally has serious environmental consequences.

Attempting to alleviate these outlined drawbacks, various advancements have been made in the art, typical of which is Canadian Patent No. 1,196,102.

This reference describes a dust collection system used in conjunction with rock drilling apparatus. The system employs a hood for disposal about a drilling member and placement over a bore hole. Upwardly surging debris from the base hole is directed to a large particle hopper and a small particle i.e. dust, filter bag. A door is provided which selectively opens to discharge debris into the mining area. Once the debris reaches a certain mass, there is no debris concentration provision.

Further, in Canadian Patent No. 1,051,866, there is disclosed another apparatus for debris containment. The document discloses the use of a two stage apparatus; the first being divided into large and medium particle containment area while the second is suited for dust removal. The advancement made is the development in the use of metal screens to allow coagulated dust etc. which forms on the screen due to moisture containing debris. The apparatus also includes air inlets which permit the screens to be cleaned.

U.S. Pat. No. 3,016,962 relates to a system of removing drill cuttings from drilling fluid as related to well drilling.

A further reference, U.S. Pat. No. 2,144,586, discloses a shroud system for use in drilling. The shroud delineated in this reference does not provide a sealing member independent of the shroud housing and accordingly, there is no sealing relationship between the shroud and the drilling means.

Similarly, U.S. Pat. No. 3,924,696, teaches a shroud structure for dust containment, however there is no indication of a sealing member capable of maintaining a sealing relationship with a drill rod or drill means. This reference in fact permits air ingress about the drill rod or drill means.

Further prior art documents include Canadian Patent Nos. 1,070,667; 1,181,016; 1,062,245; 671,325; and 1,055,475.

Although various achievements in drilling and mining technology have been developed in the art none is particularly well adapted for use in large underground mining operations and, further such an application is not contemplated by the previously disclosed art.

SUMMARY OF THE INVENTION

The present invention provides a novel method and system for underground drilling and, more particularly provides a method of collecting debris produced from an underground mining procedure.

According to one broad aspect of the present invention, there is provided a shroud structure for use in rock drilling comprising:

a hollow housing having opposed first and second faces and an outlet for discharging debris, the housing adapted to receiving drilling means therethrough;

a shroud member extending from the first of the opposed faces and adapted for contact against a rock surface;

a resilient sealing member operatively associated with the second face of the housing, the sealing member including an aperture therethrough to receive the drilling means in a substantially sealed relation.

Generally, in the underground drilling process, the use of water is required to suppress the amount of dust generated. Since the operation is subterranean, often at depths greater than 1400 meters, ground water is encountered in varying amounts with a high degree of frequency. As such, the use of conventional debris filters is limited in that the debris, particularly dust, agglomerates, due to moisture content in the debris, and this greatly impedes the efficiency of the drilling process.

Applicant, has found that the use of a cyclonic filter structure having at least two filter members therein is particularly useful for debris containment in dry underground drilling or the same in wet conditions. The cyclonic filter is particularly useful in that the water and debris can be easily removed and further facilitate removal of the fragments for placement into underground receptacle etc. In underground drilling operations where a larger hole is required, for example, 0.5–3 meters in diameter or greater, blind holes must be drilled. In conventional methods, known in the art, these holes have only been drilled from the surface since no method or apparatus has been known to achieve this result in an underground application.

According to yet another object of the present invention, there is provided a sealing member suitable for use with a shroud structure having opposed faces through which a drilling means is inserted, the member comprising:

a resilient body having an aperture therein to receive the drilling means, the body adapted for releasable mounting to one of the faces, the body being resiliently axially extensible to substantially seal about the drilling means.

According to a further object of the present invention, there is provided a drop cone assembly suitable for use with a cyclonic filter structure having an inlet and an outlet for discharging debris produced during a drilling procedure, the drop cone assembly comprising:

a tubular body having a first end adapted for connection with the outlet of the filter structure and a second end adapted for connection with a bore hole;

a debris retaining member positioned within the tubular body adjacent the first end, the retaining member adapted to retain a predetermined mass of debris and capable of opening when the predetermined mass is exceeded to thereby discharge the predetermined mass through the bore hole.

Another object of the present invention is to provide a method of disposing of debris spills generated during a drilling procedure comprising the steps of:

providing a cyclonic filter structure in being a drop cone assembly at the discharge end thereof, the assembly including a debris retaining member;

collecting a predetermined mass of debris spills in the debris retaining member;

introducing moisture into the member to concentrate the mass; and releasing the concentrated mass when the predetermined mass is exceeded.

In a further feature of the present invention, Applicant provides a method of drilling underground which substantially increases the rate of penetration without causing excessive drill bit wear. Further, using the apparatus and methods of the invention, the Applicant uses less volume of compressed air than conventional surface drilling operations. Typically, drilling bits, compressed air, illness of mine workers being exposed to airborne material in a mining area etc. have all contributed to additional expense in an already costly drilling procedure. By employing the apparatus and methods of the present invention, Applicant has found that the above limitations are easily obviated.

Having thus generally described the invention, reference will now be made to the accompanying drawings illustrating preferred embodiments.

DETAILED DESCRIPTION OF THE PREFERRED EMBODIMENTS

The present invention provides a method of drilling or boring underground with apparatus for the same.

Previous arrangements i.e. those used for surface drilling, as applied to underground drilling are limited by ineffective debris containment and other difficulties.

Applicant, in the present invention, has found that a combination of drilling apparatus and cyclonic filters sufficiently contain debris produced during an underground drilling procedure, while being unaffected by the limitations encountered in surface drilling.

In an underground drilling procedure, particularly when larger holes are required e.g. 0.3 to greater than 3 meters, blind holes must be used. Generally, a blind hole is produced by first drilling a pilot hole with suitable drilling means and subsequently reaming the hole to a larger desired diameter. The blind hole may additionally be drilled without a pilot hole. These holes have conventionally been drilled from the surface since no method or apparatus has been known to achieve this end underground, while additionally containing the debris, often having high moisture content, effectively. The conventional surface method of drilling blind holes requires vast area for equipment assembly and positioning in addition to apparatus for handling mud, water etc., and discharge areas e.g. decant ponds for the same.

Figure 1:
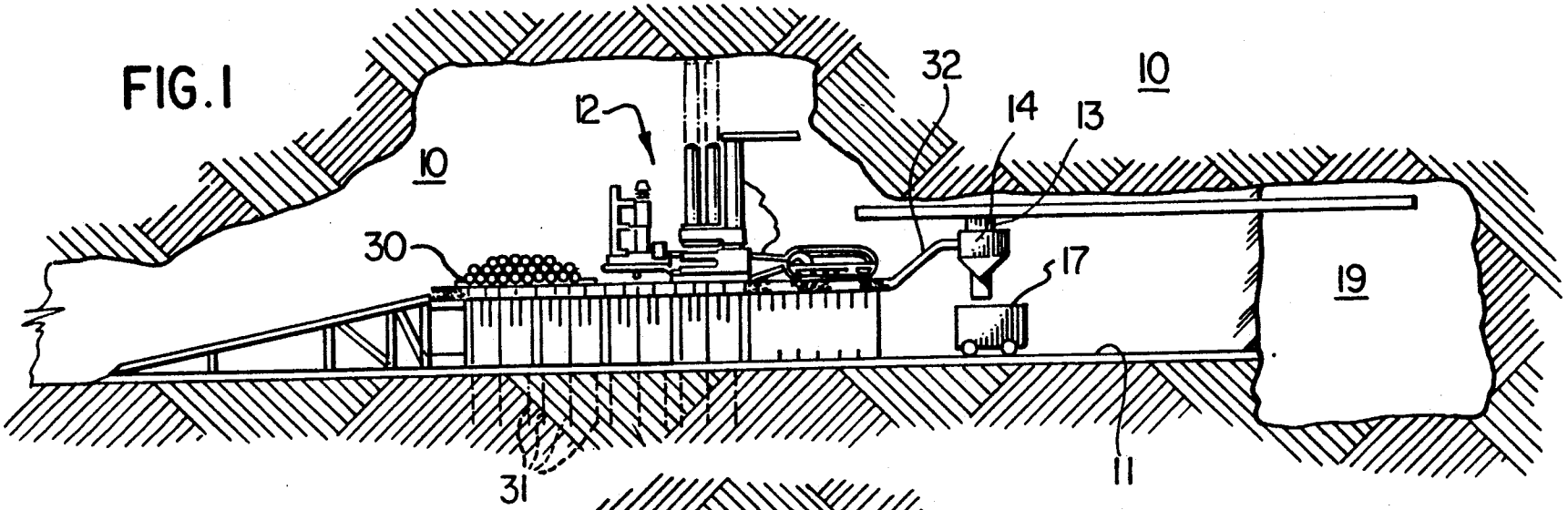
FIG. 1 is a plan view of the mining system of the present invention.
Figure 1A:
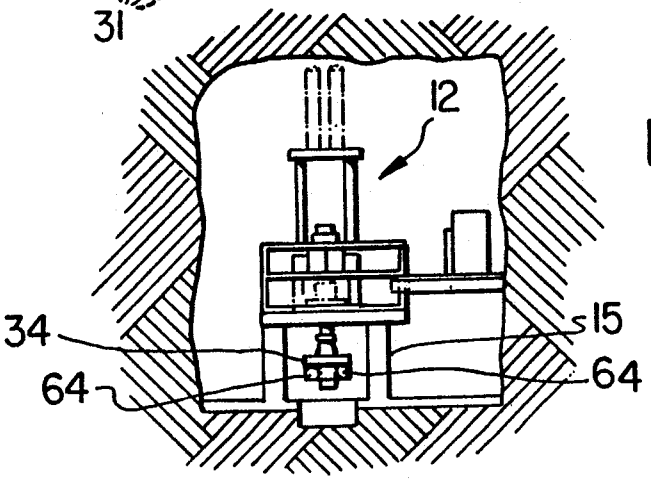
FIG. 1*a* is a side view of the mining system of FIG. 1.

A system which achieves the underground result is shown in one form diagrammatically in FIGS. 1 and 1*a*. An underground mining area, generally indicated by numeral 10, is shown wherein there is located a drilling apparatus 12 and a cyclonic filter 14.

Figure 3:
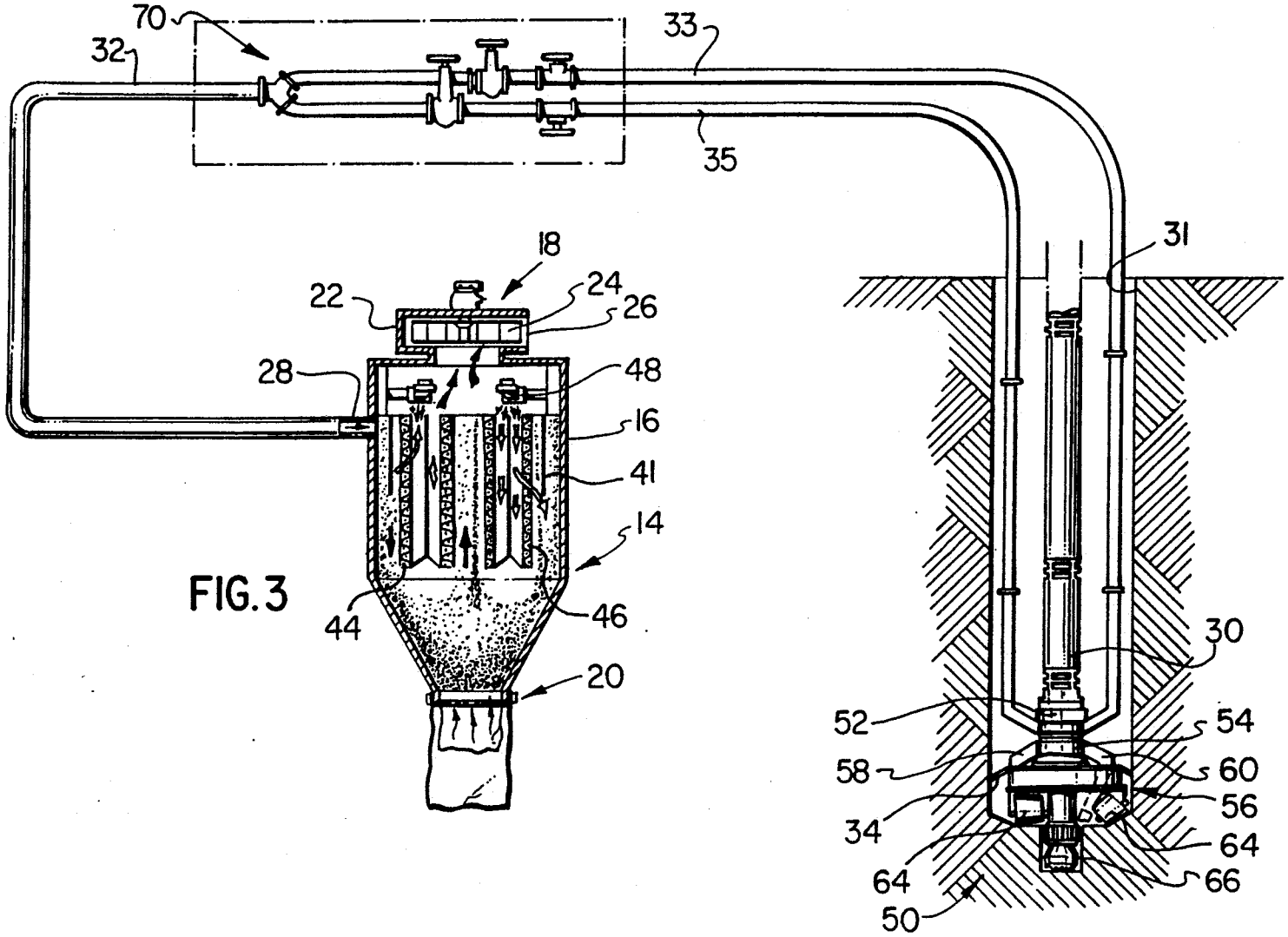
FIG. 3 is an enlarged front view of the filter used in the system of the present invention.

The cyclonic filter 14, for use in this embodiment of the invention, shown in greater detail in FIG. 3, includes a rigid outer casing 16 with upper and lower ends 18 and 20. Mounted on the upper end 18 of the filter 14 there is included a blower housing 22 and blower wheel 24 located therein. The blower wheel 24 serves to create a vacuum within the casing 16, which aids in the uptake of debris produced in a drilling operation, while exhausting clean, filtered air into the mining area 10 from port 26 projecting from housing 22. An inlet 28 adjacent top upper end 18, facilitates the incoming upwardly surging debris from a drill hole 31, as illustrated in FIG. 1, to enter the filter 14 via a suction conduit system 32 e.g. hosing, one end of which is connected therewith. The conduit system, as illustrated in one form, includes a main conduit 32 which is branched into conduits 33, 35 and connected at their ends, to a partition member 34 e.g. a shroud hereinafter described. The partition member 34 is disposed about drilling means e.g. a reamer. The conduits 33 and 35 are connected to conduit 32 such that the vacuum produced by the blower 24 of cyclonic filter 14 aids the intake of the debris into filter 14 via port 28 extending therefrom.

The debris, often containing water, particulated and fragmented rock etc, travels through the conduits 33, 35 and 32 and is eventually tangentially introduced to the filter. A barrier 41 extending around the internal periphery of filter 14 is preferably fixed therein. This acts as a rock shield to prevent high velocity incoming debris from damaging the interior of the filter 14. The heavier particles are forced to the internal periphery of the filter and subsequently drop to lower tapered end 20 of the filter 14. After sufficient building of the fragmented material, a lid, (not shown) covering the bottom of the filter 14, pivots to release the material. The particulated material i.e. dust is pulled into the coarse and fine filter elements 44 and 46 of filter 14 where it is captured, while the larger fragments collect in the lower end of the filter. These elements are continuously cleaned by impulses of compressed air supplied thereto by an impulse valve 48 affixed to an inner surface of the filter 14 proximate the elements 44 and 46.

Figure 2:
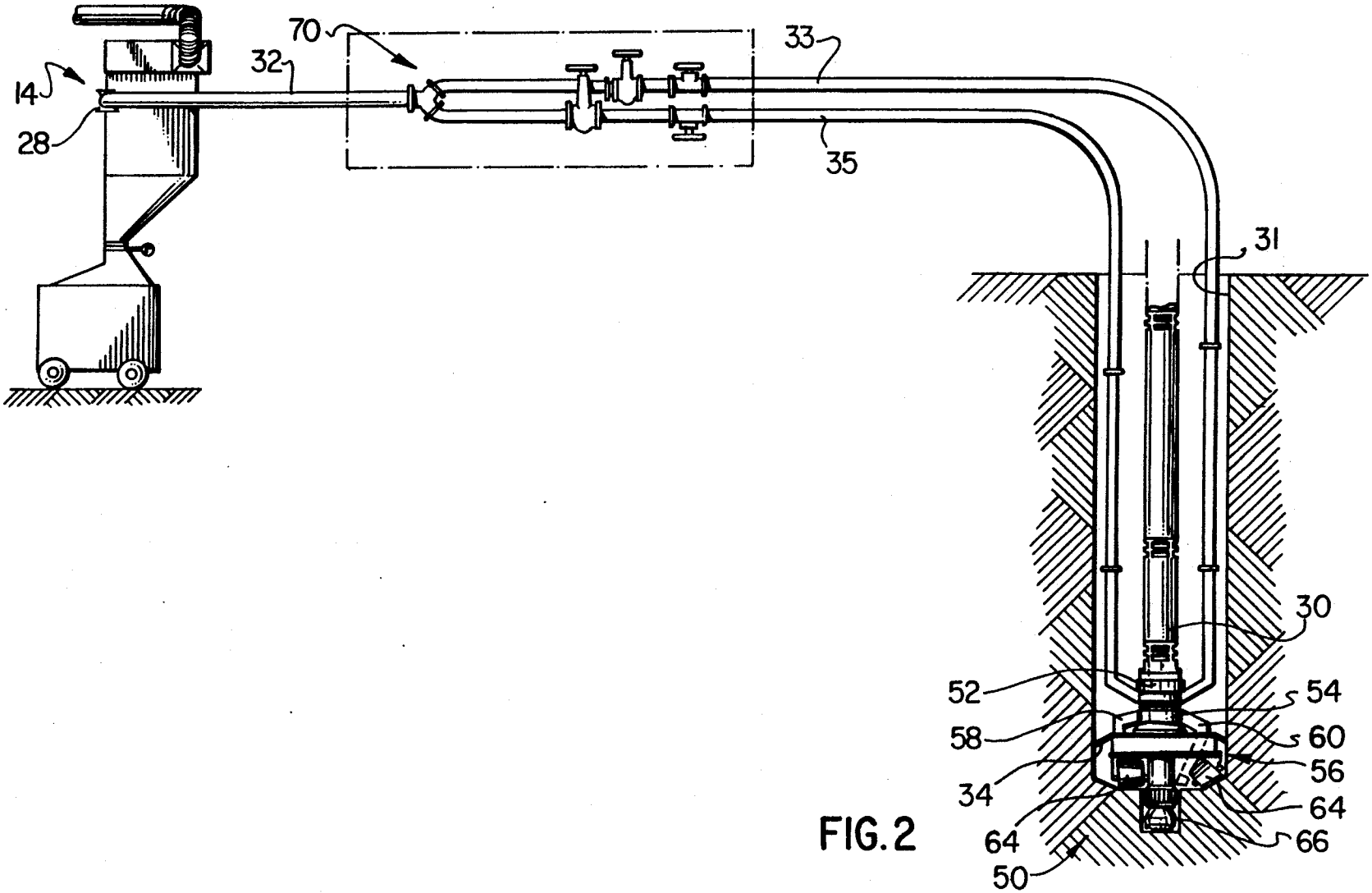
FIG. 2 is a plan view of the apparatus of the mining system of the present invention.
Figure 4:
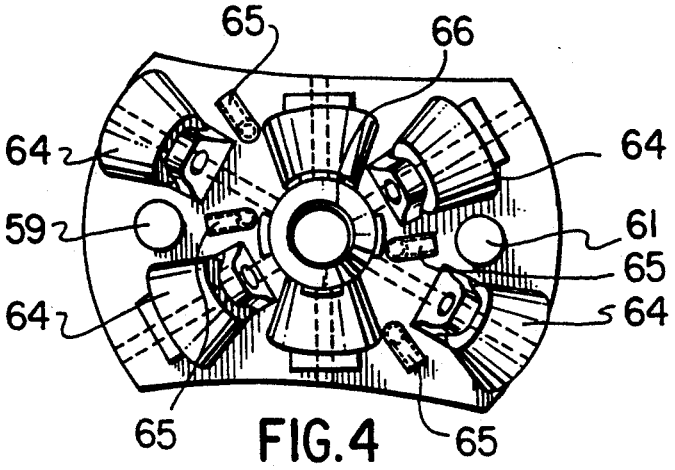
FIG. 4 is a bottom view of the drilling means of the present invention.
Figure 5:
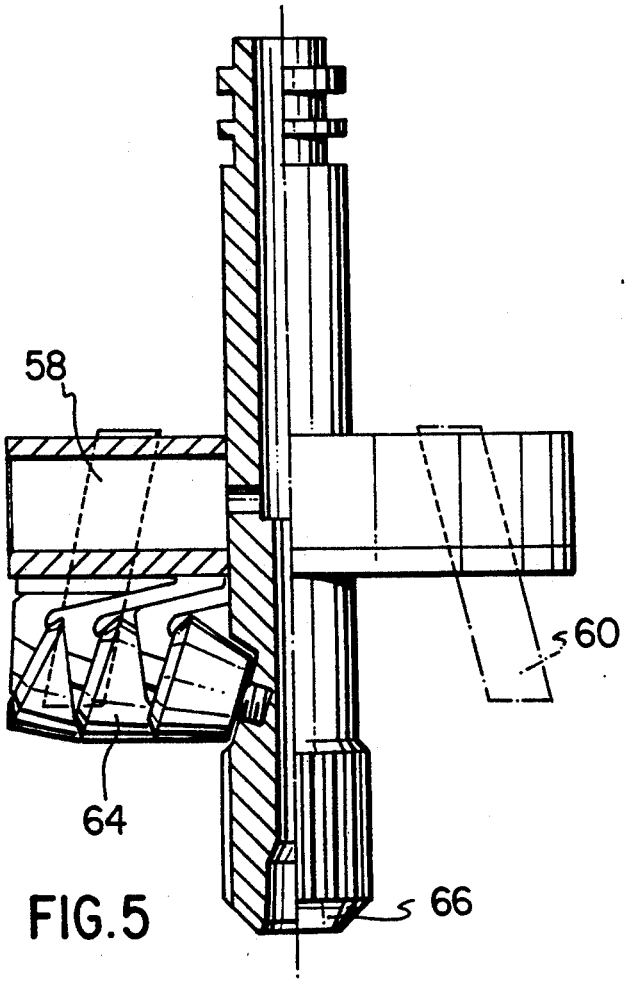
FIG. 5 is a side elevational view of the drilling means illustrated in FIG. 4.

Referring to FIG. 2, shown is a plan view of the apparatus of the present invention in greater detail. The cyclonic filter structure 14 communicates with suction conduit 32 by an inlet port 28 as herein previously described. It is preferred that suction conduit 32 branch into at least two suction conduits 33 and 35. This conduit system then extends downwardly through a drill hole 31 to the drilling means 50 at sleeve 52. The suction conduits 33, 35 are releasably and fixedly secured therewith. Sleeve 52 is mounted to a lower sleeve 54 of the drilling means 50 such that it does not rotate therewith. Additionally, sleeve 52 is connected to drill pipes 30 extending down the drill hole 31, which permit the passage of compressed air delivered thereto from the surface. In such an arrangement, the conduits 33 and 35 are in communication with the head 56 of the drilling means 50 i.e. the reamer head to receive cutting debris therein produced during a drilling operation. Extending downwardly from sleeve 54 of the drilling means 50 are, as shown in one form, a pair of debris intake members 58 and 60 terminating in apertures 59 and 61, which further extend through the partitioning member 34 (hereinafter described) to the face of the multiple drilling members 64 and 66 shown more clearly in FIGS. 4 and 5. The cutting members 64 and 66 each include an air injection member 65 associated with the head 56 of drilling means 50, which facilitates the clearing of the debris, from the cutting members 64 and 66, while subsequently suspending the debris between shroud 34 and drilling means 50 in air supplied from injection members 65 through drill pipes 30. The cutting members preferably include tungsten carbide inserts as is known in the art, and it will be understood that the drilling means 50, generally will vary in structure depending the compressive strength of rock formations being drilled.

The shroud 34 preferably comprises a highly resilient and flexible material e.g. ballistic nylon, neoprene etc. which will readily conform to irregularities of a continuously drilled surface. The shroud 34 may be fixed to or rotate with sleeve 54 of the reamer 50 while maintaining a substantial seal about the periphery of a cut hole 31. This seal of the shroud 34 is maintained due to the fact that the air volume and pressure of the compressed air being delivered to the injection members 65 via drill pipes 30 is less than the vacuum pressure of the suction conduits 33 and 35 from filter 14. In addition, since the shroud material is flexible the shroud 34 will slightly flex to permit atmospheric air to enter therein about the periphery, while maintaining a substantial seal with the drill hole 31. As such, the vacuum is prevented from becoming too great which would cause the shroud 34 to invert and thus lose its sealing capability. This allows the shroud 34 to adequately seal the reaming head 56 even under conditions where the surface being drilled fractures. The fracture, due to the vacuum pressure of suction conduits 33 and 35 and the positive pressure of air injection members 65 will cause the fracture to effectively become "plugged" with particulated debris. In this way, an effective seal will be restored rapidly.

Typically, when drilling or mining, drill bit wear due to continuous exposure to cutting debris, is a chief concern since it determines two critical factors in a drilling procedure, namely:

i) efficiency of the drilling procedure; and ii) rate of penetration.

The debris laden air surging up through the drill shaft 31, generally referred to as "bailing velocity" has been conventionally indicated in the art to be in the range of 5000 feet per minute (F.P.M.) for typical bit and drill pipe sizes. The area between the drill shaft and the bit is referred to as the annular area and tables are known in the art to indicate the required volume of air to be introduced down the drill shaft to achieve the desired bailing velocity of 5000 F.P.M. A problem occurs, however, when the annular area increases. The quantity of air volume required to achieve bit cleaning and the adequate bailing velocity becomes excessively large with increasing annular area. Applicant, by incorporating the shroud and vacuum lines of the present invention for debris containment and removal, has superceded the limitations associated with the conventional methods of known drilling methods as is illustrated in the following examples.

EXAMPLE 1

DRY DRILLING EFFECT ON PENETRATION RATE

Figure 9:
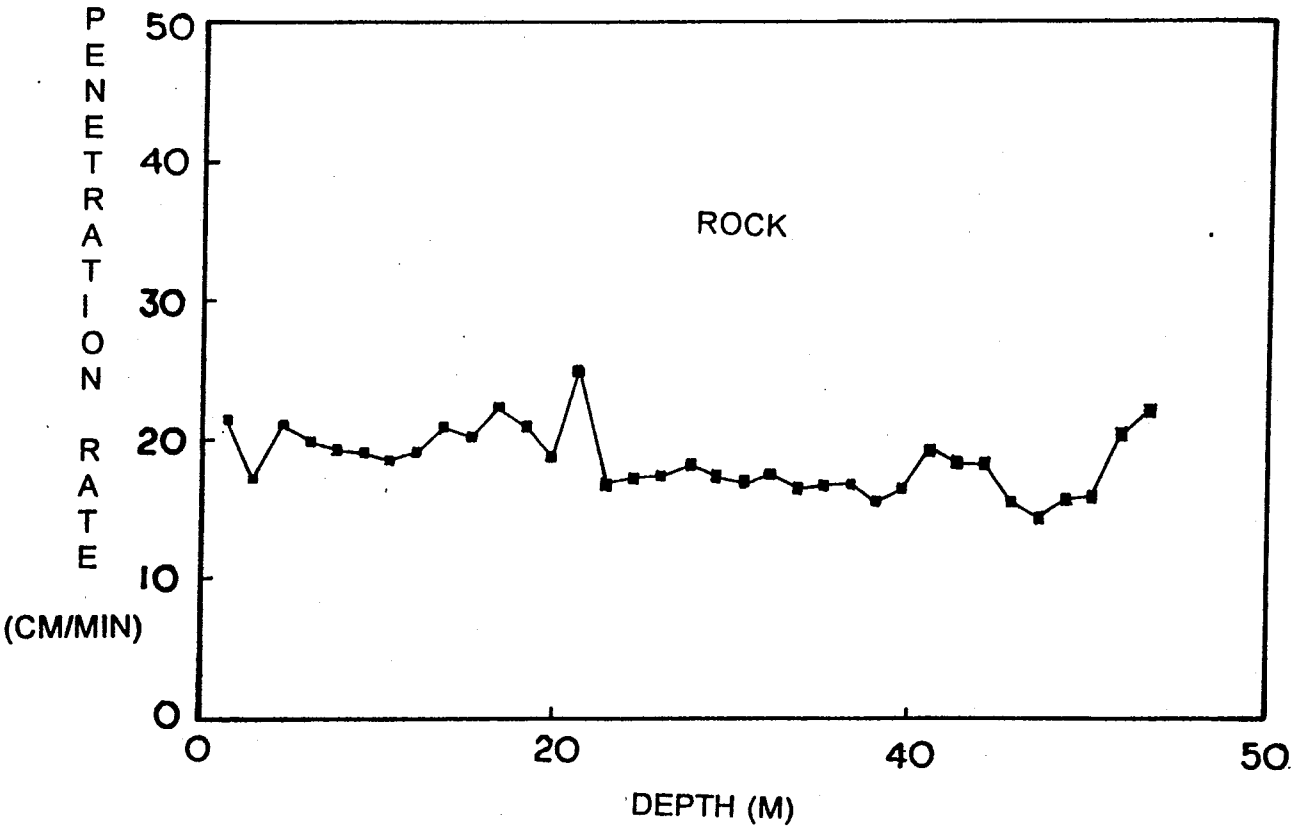
FIG. 9 is a plot (bar graph) showing penetration rate versus depth for a first hole.
Figure 10:
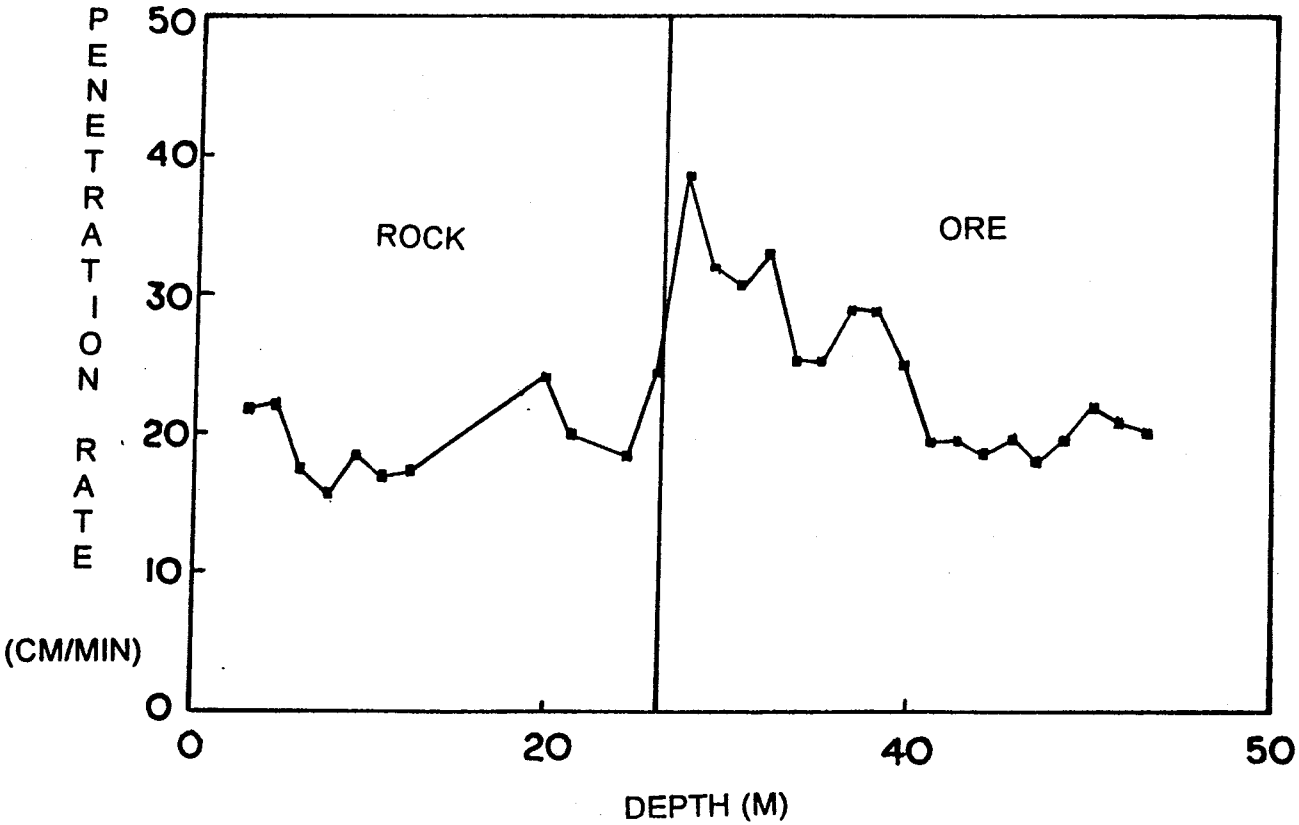
FIG. 10 is a plot (bar graph) showing penetration rate versus depth for a second hole.
Figure 11:
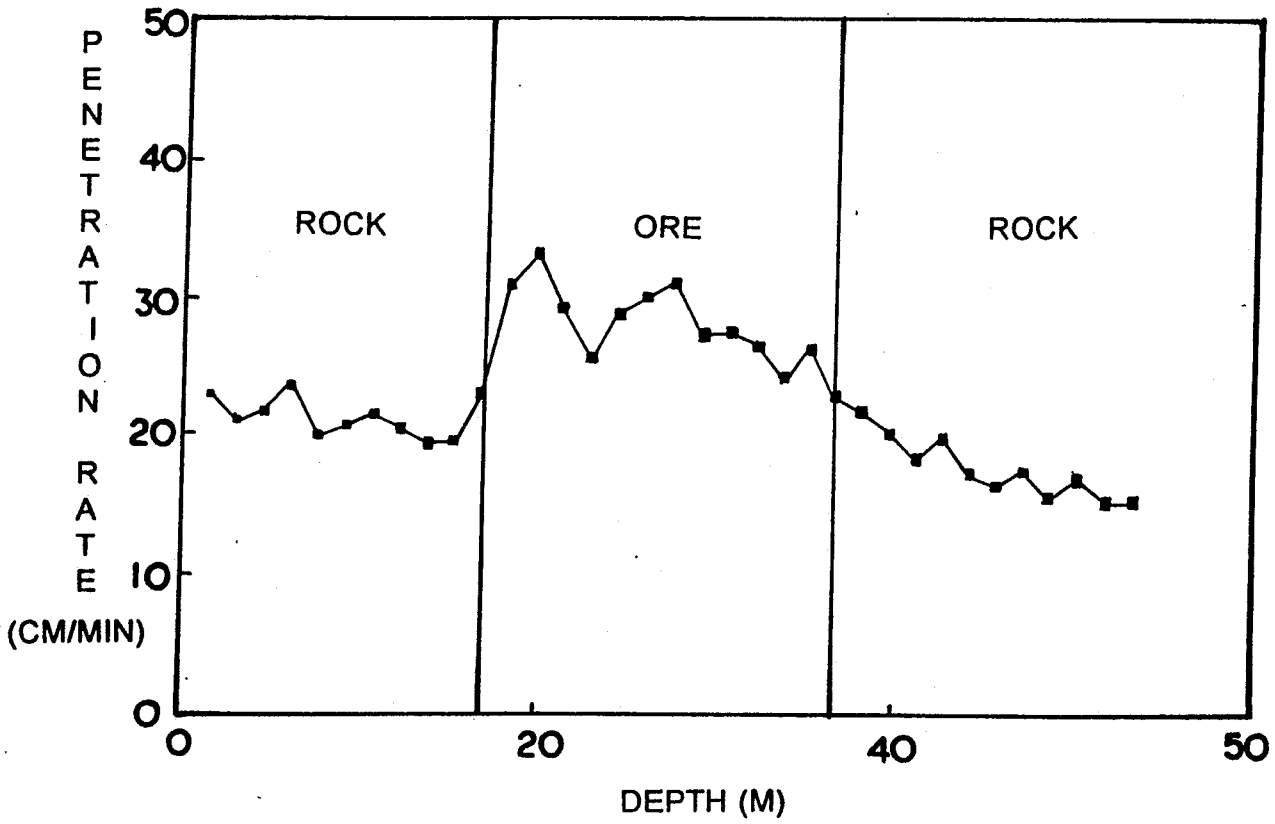
FIG. 11 is a plot (bar graph) showing penetration rate versus depth for a third hole.
Figure 12:
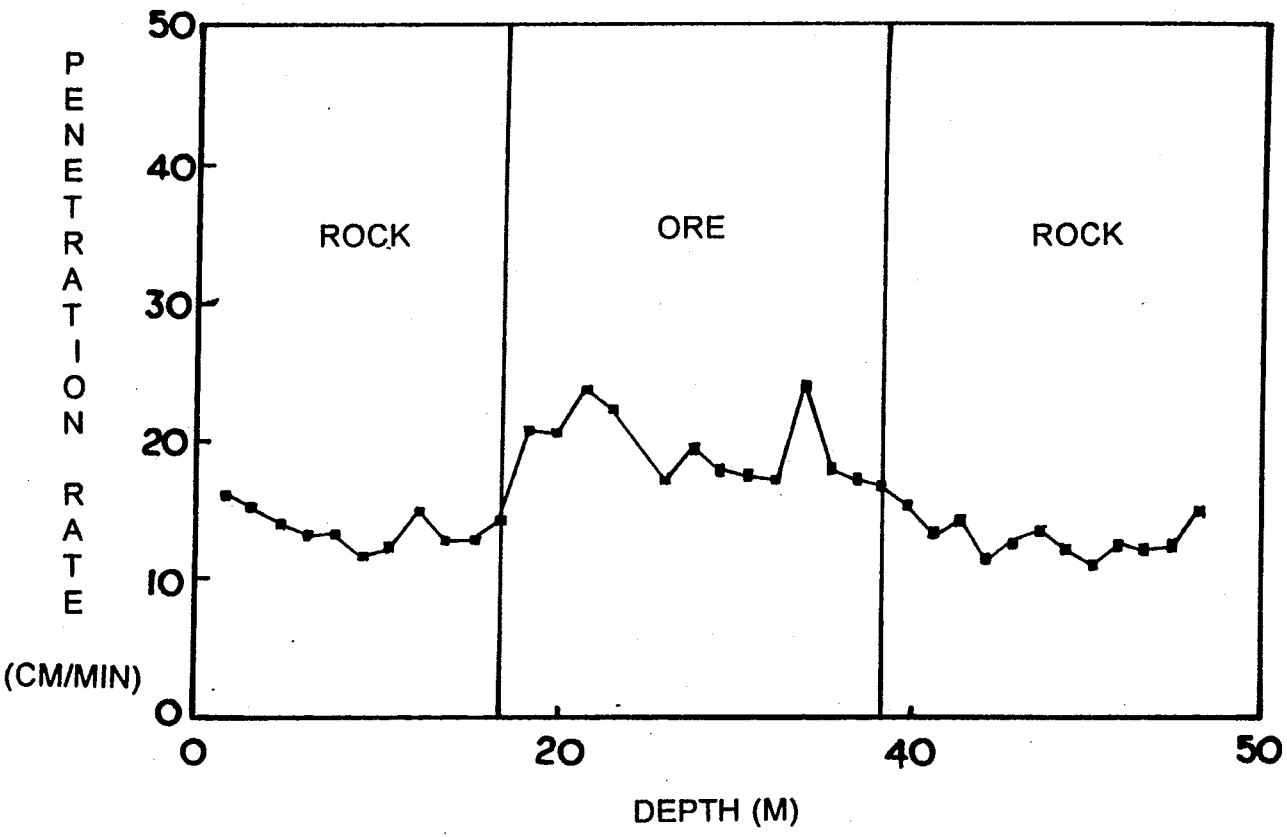
FIG. 12 is a plot (bar graph) showing penetration rate versus depth for a fourth hole.
Figure 13:
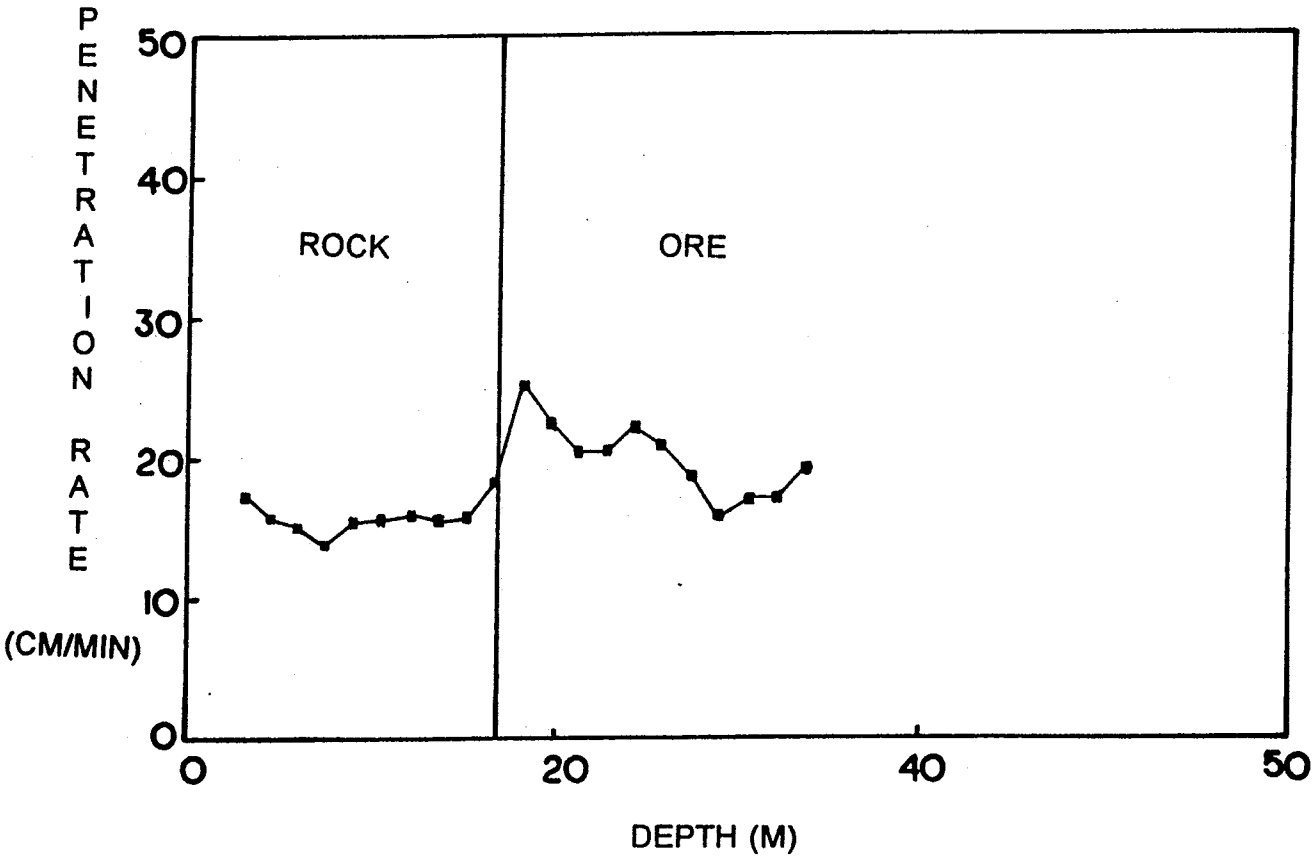
FIG. 13 is a plot (bar graph) showing penetration rate versus depth for a fifth hole.

The data illustrated in the following example describe the penetration rate data collected during a testing procedure using the methods and apparatus of the present invention. FIGS. 9 to 13-are plots of penetration rate versus depth on a 1.52 meter increment over the entire drilling depth. FIGS. 9 to 11 illustrate data for holes that were drilled dry. FIGS. 12 and 13 indicate data for holes that were drilled wet. Additionally, FIGS. 9 to 13 indicate the depth at which drilling in rock and ore intersected.

Standard statistical analysis was performed on each of the sets of data, namely, the dry drilling data and wet drilling data. The first paired data set (drilling in ore) shows mean penetration rate of 25.24 cm/min. for dry drilling and 19.41 cm/min. for wet drilling. The standard errors associated with these means are 1.04 and 0.63, respectively. A paired t-test performed on this paired data set yielded a mean difference in penetration rate of 9.52 cm/min. with a standard error of 0.94. This translates into a 49% increase in penetration rate for dry drilling in ore. The t-value from this test was 10.09 which is well above the critical value of t for this case. The second paired data set (drilled in rock) showed a mean penetration rate of 18.52 cm/min. for dry drilling and 13.71 cm/min. for wet drilling. The standard errors associated with these means are 0.32 and 0.31, respectively. A paired t-test performed on this paired data set yielded a mean difference in penetration rate of 4.97 cm/min. with a standard error of 0.29. This translates into a 35% increase in penetration rate for dry drilling in rock. The t-valve from this test was 16.93 which again falls well above the critical value of t for this case. Table 1 is a summary of results, which shows the mean penetration rates for dry and wet drilling, the standard errors associated with these means and the relative increases in penetration rate.

TABLE 1

| SUMMARY OF DRILLING DATA ANALYSIS | | | |
|---|---|---|---|
| ROCK TYPE | AVERAGE INCREASE (cm/min) | STANDARD ERROR | % INCREASE |
| ORE | 9.520 | 0.944 | 49% |
| ROC | 4.974 | 0.294 | 35% |

The above data indicates that there was greater scatter in penetration rates while drilling in ore as evidenced by the high standard errors of the means. This coincides with observations in the field and is due partly to problems that occurred with the drill bits used. The penetration rates in rock, however, have very little scatter as few problems were encountered during the collection of this data. The facts indicate that more weight should be put on the increase in penetration rate observed while drilling in rock than that observed while drilling in ore.

TABLE 2

| PENETRATION RATE DATA FROM DRY DRILLING | | | |
|---|---|---|---|
| HOLE DEPTH (m) | HOLE No 1 (cm/min) | HOLE No 2 (cm/min) | HOLE No 3 (cm/min) |
| 1.524 | 21.345 | 22.917 | . |
| 3.048 | 17.047 | 20.963 | 21.586 |
| 4.572 | 20.934 | 21.709 | 22.151 |
| 6.096 | 19.818 | 23.850 | 17.299 |
| 7.620 | 19.146 | 19.922 | 15.425 |
| 9.144 | 19.050 | 20.707 | 18.339 |
| 10.668 | 18.518 | 21.556 | 16.692 |
| 12.192 | 19.074 | 20.595 | 17.124 |
| 13.716 | 20.905 | 19.316 | . |
| 15.240 | 20.106 | 19.513 | . |
| 16.764 | 22.216 | 22.780 | . |
| 18.288 | 20.848 | 31.039 | . |
| 19.812 | 18.563 | 33.203 | 24.000 |
| 21.336 | 24.943 | 29.251 | 19.767 |
| 22.860 | 16.803 | 25.570 | . |
| 24.384 | 17.201 | 28.918 | 18.186 |
| 25.908 | 17.318 | 30.059 | 24.345 |
| 27.432 | 18.121 | 31.166 | 38.485 |
| 28.956 | 17.259 | 27.263 | 31.883 |
| 30.480 | 16.747 | 27.509 | 30.419 |
| 32.004 | 17.477 | 26.643 | 32.774 |
| 33.528 | 16.369 | 24.076 | 25.190 |
| 35.052 | 16.656 | 26.504 | 24.943 |
| 36.576 | 16.784 | 22.611 | 28.918 |
| 38.100 | 15.394 | 21.679 | 28.809 |
| 39.624 | 16.476 | 20.320 | 24.902 |
| 41.148 | 19.242 | 18.208 | 19.218 |
| 42.672 | 18.251 | 19.844 | 19.389 |
| 44.196 | 18.100 | 17.124 | 18.361 |
| 45.720 | 15.456 | 16.334 | 19.488 |
| 47.244 | 14.310 | 17.437 | 17.762 |
| 48.768 | 15.679 | 15.347 | 19.414 |
| 50.292 | 15.892 | 16.858 | 21.771 |
| 51.816 | 20.266 | 15.179 | 20.622 |
| 53.340 | 21.897 | 15.104 | 19.870 |
| 54.864 | . | . | . |
| 56.388 | . | . | . |

(.) indicates a missing value

TABLE 3

| PENETRATION RATE DATA FROM WET DRILLING | | |
|---|---|---|
| HOLE DEPTH (m) | HOLE No 1 (cm/min) | HOLE No 2 (cm/min) |
| 1.524 | 16.059 | . |
| 3.048 | 14.985 | 17.377 |
| 4.572 | 13.918 | 15.679 |
| 6.096 | 13.115 | 15.119 |
| 7.620 | 13.172 | 13.817 |
| 9.144 | 11.519 | 15.456 |
| 10.668 | 12.221 | 15.679 |

TABLE 3-continued

| PENETRATION RATE DATA FROM WET DRILLING | | |
|---|---|---|
| HOLE DEPTH (m) | HOLE No 1 (cm/min) | HOLE No 2 (cm/min) |
| 12.192 | 14.796 | 16.144 |
| 13.716 | 12.605 | 15.793 |
| 15.240 | 12.807 | 15.908 |
| 16.764 | 14.098 | 18.450 |
| 18.288 | 20.622 | 25.358 |
| 19.812 | 20.402 | 22.611 |
| 21.336 | 23.628 | 20.539 |
| 22.860 | 22.087 | 20.650 |
| 24.384 | . | 22.281 |
| 25.908 | 17.028 | 21.021 |
| 27.432 | 19.439 | 18.768 |
| 28.956 | 17.680 | 16.008 |
| 30.480 | 17.299 | 17.259 |
| 32.004 | 16.990 | 17.220 |
| 33.528 | 24.114 | 19.464 |
| 35.052 | 17.721 | . |
| 36.576 | 16.971 | . |
| 38.100 | 16.638 | . |
| 39.624 | 15.164 | . |
| 41.148 | 13.070 | . |
| 42.672 | 14.190 | . |
| 44.196 | 11.214 | . |
| 45.720 | 12.679 | . |
| 47.244 | 13.559 | . |
| 48.768 | 12.047 | . |
| 50.292 | 10.948 | . |
| 51.816 | 12.421 | . |
| 53.340 | 11.962 | . |
| 54.864 | 12.231 | . |
| 56.388 | 14.725 | . |

(.) indicates a missing value

RESULT OF COMPILED DATA

It can be clearly seen from a comparison of, for example, FIGS. 10 and 13 that dry drilling in ore, employing the method of the present invention, a substantial increase in penetration rate is achieved when compared to results obtained in a wet drilling operation. Similarly, a significant increase in rate of penetration is illustrated when dry drilling rock, according to the methods of the present invention, versus wet drilling. Table 3 further illustrates the superiority of penetration rate in dry drilling, namely, 49% increase in penetration rate in comparison to wet drilling and a 35% increase in penetration rate in dry drilling rock formations.

EXAMPLE 2

DUST MONITORING DATA FOR AN UNDERGROUND DRY DRILLING OPERATION

The following data will indicate data for the levels of dust generated during the dry drilling operation as compared with those levels generated during wet drilling. In obtaining the data, the personal sampling outfit consisted of two basic parts, namely, a rechargeable battery powered diaphragm type pump with calibrated flow rates and the cyclonic filter assembly with a preweighed filter holder to collect the dust sample. The pump and cyclonic filter assemblies were suspended from within the mining area at three different locations so that air could be monitored at the intake, operator and exhaust locations.

Extensive studies have been performed with respect to dust control in underground mining operations. Such studies performed by the American Conference of Governmental Industrial Hygienists (ACGIH) have generated various categories of threshold limit values. The particular category that is of interest is the Threshold Limit Value-Time Weighted Average (TLV-TWA). This is defined as the time-weighted average concentration for a normal 8-hour work day or 40-hour work week to which nearly all workers may be repeatedly exposed without adverse effect.

The samples collected were combined and averaged so that a time-weighted average concentration of airborne respirable dust during both wet and dry drilling at each location i.e. intake, operator and exhaust locations could be obtained. The results indicated that there was no appreciable increase in dust concentration during dry drilling. The average dust concentrations during wet and dry drilling were approximately 0.14 mg/m$^3$ and 0.17 mg/m$^3$, respectively. Both values of dust concentration obtained fell well below the TLV-TWA of 1.27 mg/m$^3$ assuming a silica content of less than 10%. The TLV-TWA for respirable dust containing silica, in mg/m$^3$, is calculated by adding 2% to the respirable quartz and dividing that number by 10. Provided dust concentrations were maintained at the levels obtained during this testing period, it is possible that the silica content in the dust may have been as high as 60% without the TLV-TWA being exceeded.

The dust concentrations at each station for the sampling period were calculated along with their respective TLV-TWA the data of which is indicated in Table 4. The time-weighted average concentration at each station over the entire testing program was obtained by summing the results from the dust sampler and dividing by the total volume of air sampled i.e. flow rate x sampling. This data is indicated in Table 5.

TABLE 4

DUST MONITORING RESULTS

| Sample # | Location | $SiO_2$ mg | Drill. Type | Wgt mg | Vol m$^3$ | Conc mg/m$^3$ | TLV mg/m$^3$ |
|---|---|---|---|---|---|---|---|
| 130008-90 | INTAKE | <0.010 | DRY | 0.04 | 0.459 | 0.087 | 0.370 |
| 130009-90 | OPERATOR | <0.010 | DRY | 0.05 | 0.459 | 0.109 | 0.455 |
| 130010-90 | EXHAUST | <0.010 | DRY | 0.01 | 0.459 | 0.022 | 0.098 |
| 130011-90 | INTAKE | <0.010 | DRY | 0.03 | 0.374 | 0.087 | 0.283 |
| 130012-90 | OPERATOR | <0.010 | DRY | 0.06 | 0.374 | 0.160 | 0.536 |
| 130013-90 | EXHAUST | <0.010 | DRY | 0.07 | 0.374 | 0.187 | 0.614 |
| 130014-90 | INTAKE | <0.010 | DRY | 0.02 | 0.510 | 0.039 | 0.192 |
| 130015-90 | OPERATOR | <0.010 | DRY | 0.11 | 0.510 | 0.216 | 0.902 |
| 130016-90 | EXHAUST | 0.015 | DRY | 0.16 | 0.510 | 0.314 | 0.879 |
| 130017-90 | INTAKE | <0.010 | DRY | 0.01 | 0.680 | 0.015 | 0.098 |
| 130098-90 | OPERATOR | <0.010 | DRY | 0.13 | 0.680 | 0.191 | 1.032 |
| 130019-90 | EXHAUST | <0.010 | DRY | 0.11 | 0.680 | 0.162 | 0.902 |

TABLE 5

DUST CONCENTRATION DATA AT DIFFERENT LOCATIONS

| LOCATION | DRY | AVG |
|---|---|---|
| INTAKE | 0.049 | |
| OPERATOR | 0.173 | 0.173 |
| EXHAUST | 0.173 | |

As shown by the results of Tables 4 and 5, the average dust concentration of 0.173 is well below the TLV-TWA limitations of 1.27 mg/m$^3$ assuming a silica content of less than 10%. In effect, what this also means is that given the permissible dust concentration maximum, silica content in dusts can be as high as 60% without the TLV-TWA being exceeded.

GENERAL CONCLUSIONS

By employing the methods and apparatus of the present invention, it is clear that numerous advances are achievable in drilling efficiency. The results indicate that substantial increases in rates of penetration in dry drilling are obtainable using the concept of debris removal by suction using mine air or, alternatively, higher pressure air, according to the present invention. Further, the method of dry drilling as indicated herein is also responsible for substantially reducing drill bit wear. When considered collectively, the above advantages directly translate to increased mine productivity and substantial savings in drilling costs.

Referring back to FIGS. 1 through 3, the air introduced down the drill hole 31 to the reamer cutting members 64 and 66 is typically from about 700 C.F.M. to about 3000 C.F.M. This will vary depending on the hole diameter, penetration rate and mass of the material being drilled. The air introduced down the drill pipes 30 to the air injection members 65 cleans the cutting members 64 and 66 and causes the debris to become suspended in the area defined between the drilling surface and the shroud 34. The amount of air required is calculated by known methods to yield a 5000 F.P.M. velocity for typical bit diameter and pipe sizes. The conduits 33 and 35 secured to sleeve 52 capture and evacuate the debris from the area. The debris then travels upwardly through the conduits, under the action of vacuum, to reach port 28 of the cyclonic filter structure 14 where it is filtered as herein previously described. It is preferred that the conduits 33 and 35 include a valve system 70 (FIG. 3) to facilitate the unplugging of the conduits. The valve system 70, may also include ports thereon to allow sampling of the debris material for examination of size, content etc. In addition, the conduit system may include in line pressure reading instrumentation for example, manometers etc. to monitor the system during a drilling procedure. In this arrangement, the operation may be monitored remotely from the drilling site. This arrangement is particularly advantageous when drilling is required in a hazardous area, or when mining toxic materials. Further, the valve system permits a user to quickly remedy any anomalies or difficulties encountered during a drilling procedure. One such difficulty occurs when a drill bit encounters clay deposits. Conventional systems would require partial disassembly of the drilling apparatus to permit the dissolution of the clay. In the system of the present invention one need only insert a suitable solvent into the conduit system to provide immediate resumption of the drilling procedure.

In operation, as shown in one form in FIGS. 1 and 1*a*, the drilling apparatus 12 is located on suitable spacer means 15 e.g. concrete uprights in a desired position on the surface 11 to be mined. The centrifugal filter 14 is positioned in a suitable location within the mining area 10. The filter 14 may be suspended by suitable means 13 e.g. hooks cables etc. at a point distant from the drilling apparatus 12 or may be releasably secured to the drilling apparatus 12 at a convenient location thereon. The partitioning member 34 and filter 14 are associated by connecting the hose 32 to individual ports thereof as previously described. As the drilling means 50 bores into the surface 11 of the area 10 progressively deeper, drill pipes 30 are placed down the hole 31 to facilitate communication of the compressed air source (not shown) with the air injection members 65 and reamer head 56 of the drilling means 50. The debris produced from the reaming operation, particularly the larger fragments of rock eventually collect within the bottom of the cyclonic filter structure 14 as previously described herein. The debris may be discarded into a suitable collection source 17 e.g. a cart, which could be subsequently moved to a more convenient area e.g. a storage bay 19 to keep the drilling site clear.

Figure 6:
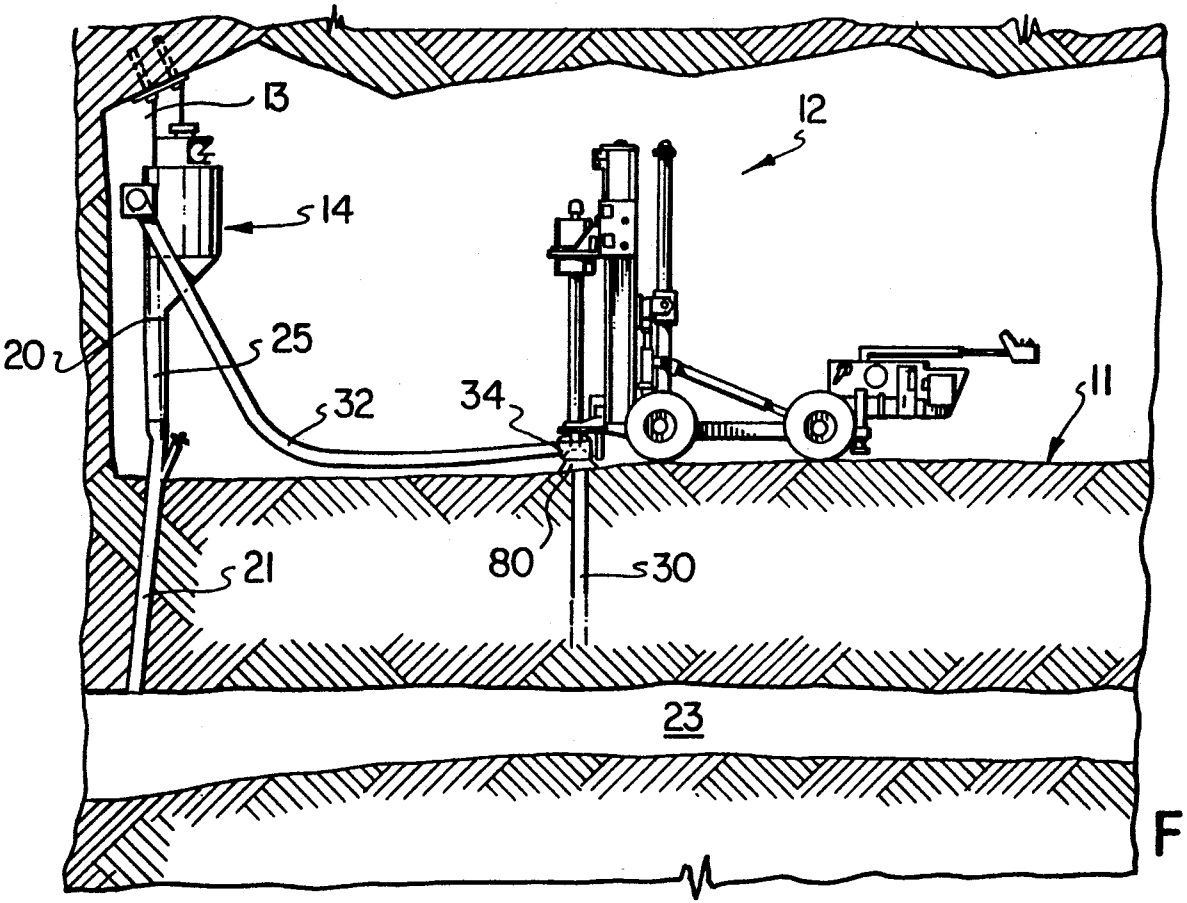
FIG. 6 is a plan view of the drilling system according to another embodiment of the present invention.
Figure 7:
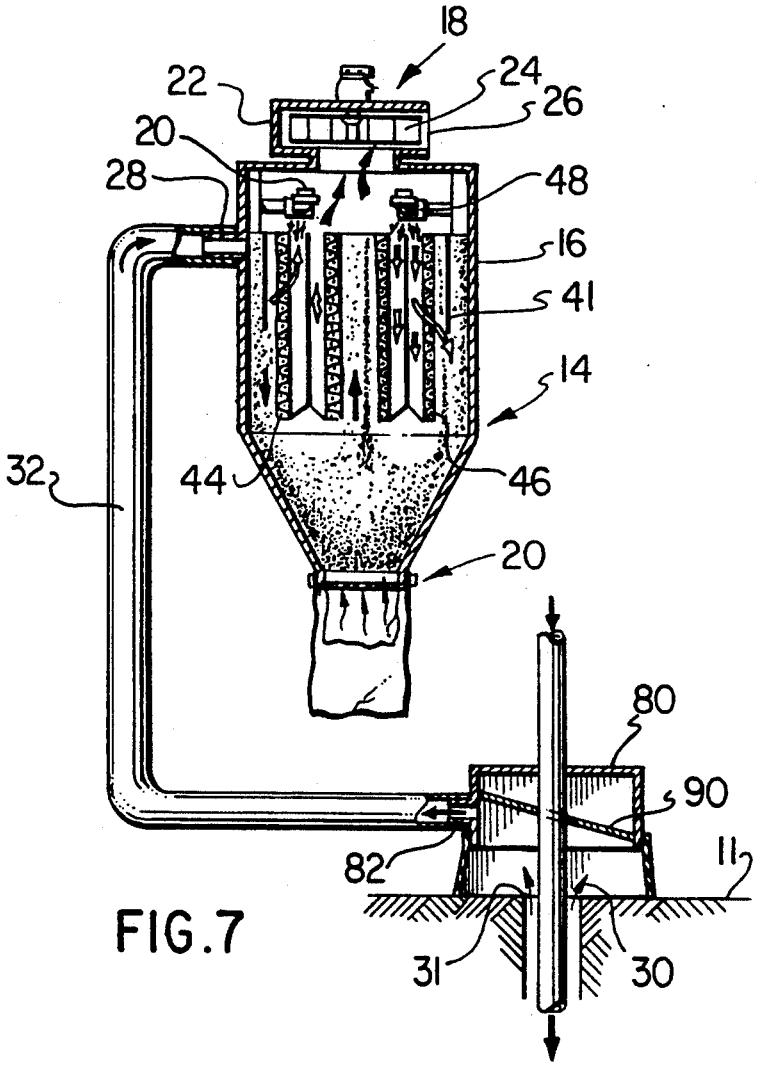
FIG. 7 is an enlarged view of the cyclonic filter structure used in the embodiment illustrated in FIG. 7.
Figure 8:
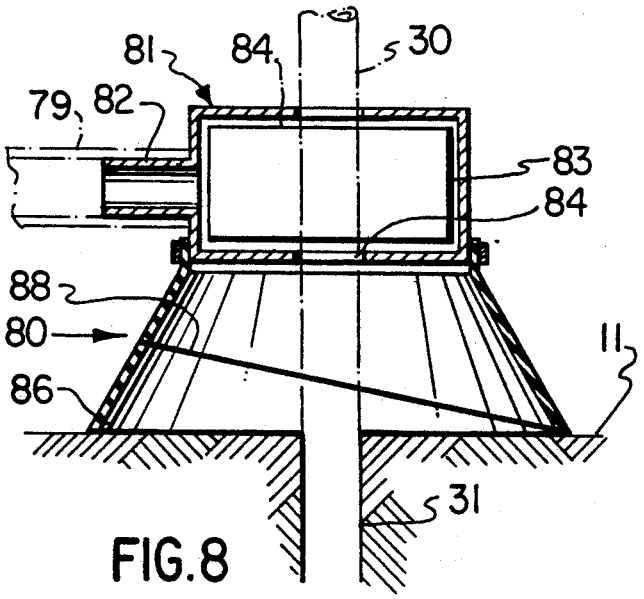
FIG. 8 is an enlarged partially cut-away view of the shroud means employed in the embodiment illustrated in FIG. 7.

In another embodiment, such as that shown in FIGS. 6, 7 and 8 similar numerals from previous drawings illustrate similar components in this embodiment. In such an arrangement, as would be employed in, for example, blast hole drilling the centrifugal filter 14 allows the upwardly surging debris from drill hole 31 to enter the filter 14 via conduit 32, one end of which is connected to inlet 28. The second end is connected to a port 82 extending from a sleeve 79 rotatably mounted on shroud housing 81. In this embodiment, the shroud 80, in operative association with, and projecting downwardly from housing 81, remains disposed over the drill hole 31 on the surface 11 of the area being drilled, while being positioned about the drilling means 50. Additionally, a drill pipe sealing member 83 may be fixedly secured within housing 81. The sealing member 83 preferably includes, within the body thereof, a pair of spaced apart apertures 84 which register in alignment to provide an effective seal about a drill pipe 30. The flexible material of the sealing member 83 will thus allow further drill pipes to be inserted within the drill hole 31, without depreciating the seal about the same. As such, debris surging upwardly through the drill hole 31 will not escape housing 81 prior to entering into filter 14.

In operation, the vacuum produced in the conduit 32 from filter 14 is effective for debris uptake therethrough and contributes in maintaining a substantial seal of shroud 80 on surface 11. This is more clearly illustrated in FIG. 8.

Further, it is preferred that the shroud 80 include a supplementary skirt 86, of greater length than shroud 80. The skirt 86 is secured about the periphery of shroud 80 by suitable means e.g. clamping, thermal or chemical bonding etc. The skirt 86 preferably comprises a similar material as the shroud 80 and is angularly inclined to facilitate angular drilling, i.e. off the vertical. In such an arrangement, one may drill from a plurality of angles, while a substantial seal is maintained at the drilling surface. In addition, when skirt 86 is not required it may be flipped upwardly along hinge line 88 to expose shroud 80. The shroud 80 may include an upwardly inclined deflector 90 therein to direct the surging debris towards port 82. The compressed air entering drill pipe 30 cleans the face of the drill bit (not shown) and operates a percussion hammer bit which would be used in such an operation. The debris travels upwardly through the drill hole 31 to be initially contained within the containment area defined by the surface 11 and shroud 80 for subsequent passage into cyclonic filter 14. In the event that lateral fractures occur during the drilling procedure, the effectiveness of debris containment will not be adversely affected as previously outlined herein.

In further embodiments, the shroud may be manufactured having a specific angle, or detachable skirts may be manufactured at varying angles for connection with existing shrouds.

To eliminate the buildup of fragmented debris within the area 10, a shaft 21 may be drilled in the surface 11 to allow the fragments to drop therethrough preferably into a lower reamed area 23. A suitable conduit 25 extending from the end 20 of the filter can be employed to achieve this result. Further, since the conduit 32 is connected at port 82 on the rotatable sleeve 79, the filter 14 may be moved easily within the mining area 10 for discharge of debris into any number of shafts 21 drilled therein.

Figure 14:
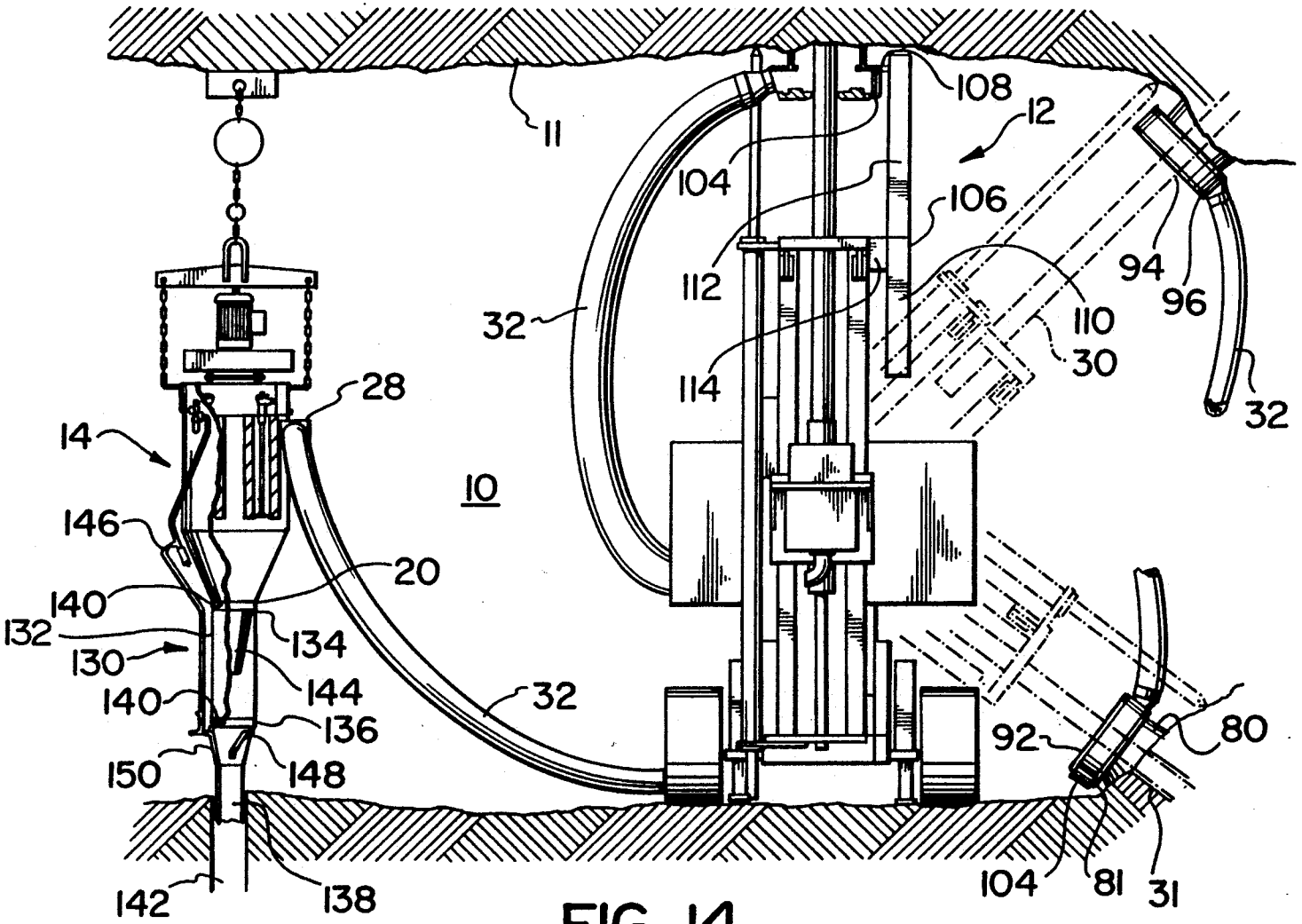
FIG. 14 is a plan view of the drilling system according to a further embodiment thereof.

A further embodiment according to the present invention is illustrated in FIG. 14 in which common elements from previous embodiments are represented by similar numerals.

Figure 15:
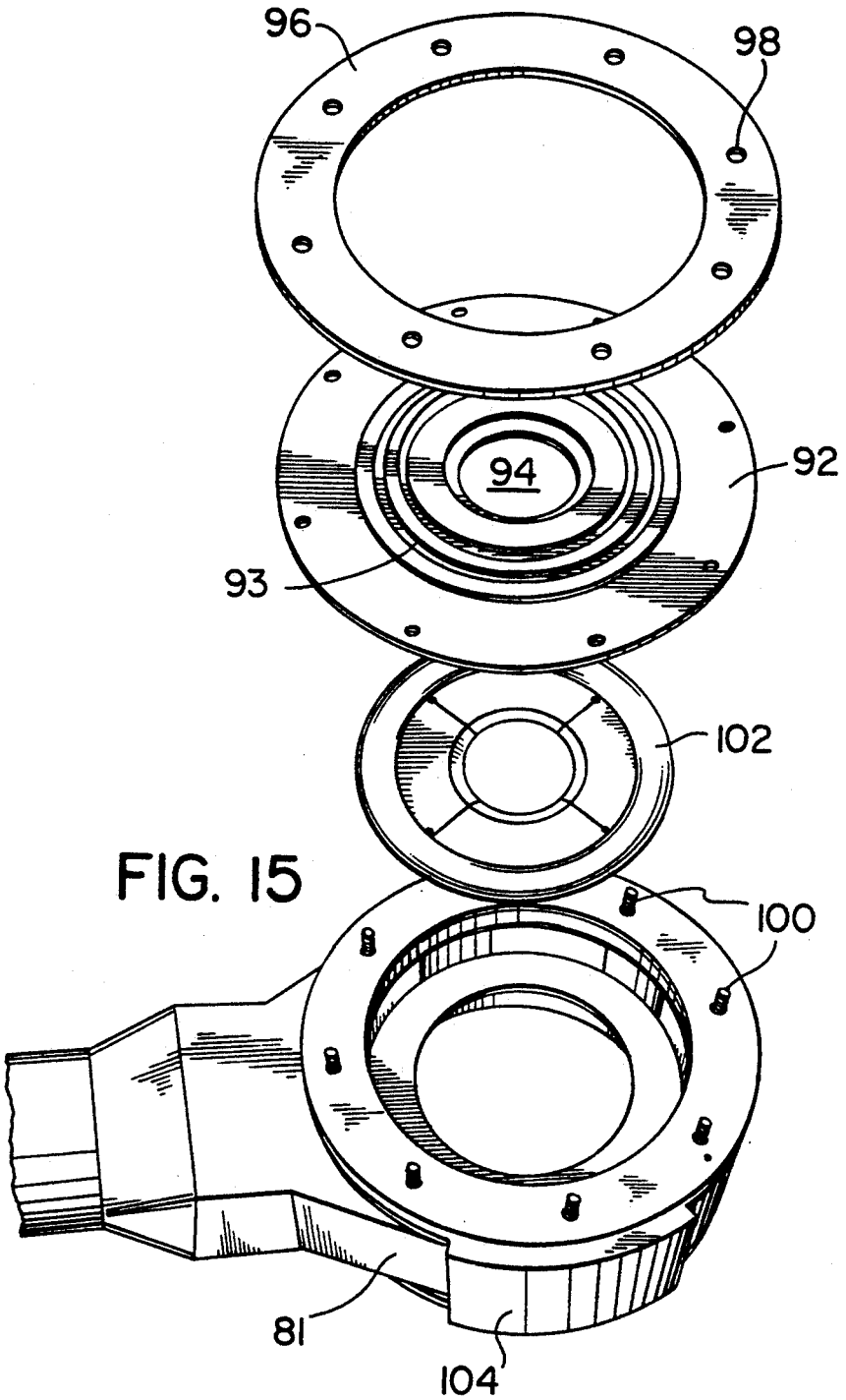
FIG. 15 is an exploded view of the shroud structure according to a further embodiment.

In this embodiment, the shroud 80 includes a sealing member 92, which in a preferred form, comprises a pleated structure, shown more clearly in FIG. 15, in which the pleats 93 are coaxial. In this manner, the sealing member 92 is axially extensible. An aperture 94 permits access of the drill pipe 30 therein. A retaining ring 96 is provided with bolt holes 98 and overlies, to releasably clamp member 92 when positioned on bolts 100 of housing 81. A sealing gasket 102 is additionally provided within housing 81.

The use of a pleated sealing member 92 has been found to be particularly advantageous in terms of maintaining a sealing relationship between the drill pipe 30 and the sealing member 92 regardless of its surface irregularities e.g. dents, warps of the latter or during periods of oscillation. This arrangement has further attendant advantages in terms of maintaining a substantially debris free environment.

Housing 81 additionally includes a metal pad 104 to which may be connected, via suitable means, or jack assembly 106 as illustrated in FIG. 14.

The assembly 106 provides a mounting plate 108 which is adapted for connection with the pad 104 of housing 81. Rotatably mounted to plate 108 is a first column 110 on which is slidably received a second column 112. Column 110 includes means 114 for mounting the assembly 106 to the drilling apparatus 12. Fluid cylinders, not shown, are included in the assembly 106 to effect the slidable movement of column 112. In this manner, the housing 81 can be urged against the rock surface 11 to enable a substantial sealing relationship between the former and the skirt 86. Further, the provision of a rotatable plate 108 permits the shroud 80 to be relocated very easily to a variety of positions.

Returning to FIG. 14 and with particular reference to the cyclonic filter structure 14, shown partially cut away, there is provided a drop cone assembly generally represented by numeral 130. The incorporation of the assembly 130 has been found to be of particular value for use in the field. The assembly 130 includes a tubular body 132 having a first end 134 connected to end 20 of filter 14. A second end 136 opposed from end 134 is connected to a tubular extension 138. Connection of the body 132 and extension 138 is achieved via suitable clamp means 140 e.g. circlips. Extension 138 extends downwardly within, in a frictionally engaged relationship, into a bore hole 142. To this end, extension 138 is preferably fabricated from a rigid, durable material, an example of which may be steel, aluminum, etc. In this arrangement, debris received into inlet 28 is eventually transported into bore hole 142 described in greater detail hereinafter.

Returning to tubular body 132, the same is preferably formed from a durable resilient material capable of flexure. Suitable materials generally representative of such a class include, nylon, rubber, etc.

Mounted within body 132, in a coaxial relationship therewith, there is included a hollow debris or spoils retaining member 144. Similar to body 132, it is preferred that member 144 be fabricated of similar materials and that the member generally subscribe to an approximately conical shape being disposed in an inverted attitude. Due to the resiliency of the member 144, the same is capable of flexure and this feature is particularly advantageous when in a negative pressure environment as is produced during the operation of the cyclonic filter 14. The negative pressure permits the vertex or tip portion of the retaining member 144 to self seal. This facilitates the collection of debris, spoils, etc. in the retaining member 144. A vibrating member 146 positioned at the lower end of the cyclonic filter 14 is provided to assist in moving the debris into the retaining member 144.

During the drilling procedure, debris collects on the retaining member 144 until such time as the weight of the debris exceeds the force of the suction closure of the retaining member 144; at this point, the collected debris falls as a concentrated mass through the extension 138. Moisture introduced into the debris at the retaining member 144 assists in "binding" the debris into a concentrated mass. This is particularly attractive since the debris is removed from the mining area 10 to thereby keep the area productive and the debris is dropped intermittently in "plugs" into bore hole 142 rather than as a regular stream which inevitably leads to excessive dust generation. Extension 138 includes an air jet adjacent the top thereof to alleviate debris blockages. Further, the extension 138 includes mounting means 150 e.g. clamps etc. for mounting ancillary gear, e.g. fluid conduits, the latter being useful within extension 138 to further enhance dust abatement or alleviate blockages when required.

As will be appreciated by those skilled, the conical retaining member will vary in size as will the diameter of the aperture of the vertex. When the filter generates a very high negative pressure, a larger aperture is permissible at the vertex and accordingly a greater mass of debris may be retained prior to release.

In terms of the general conical structure of the retaining member, it has been found that this shape is particularly useful since the same is not susceptible to evagination in high vacuum conditions. Overall, the system incorporating the pleated seal member, as well as the drop cone assembly, provides for a more efficient and more importantly, salubrious environment to which mine workers are exposed.

Figure 16:
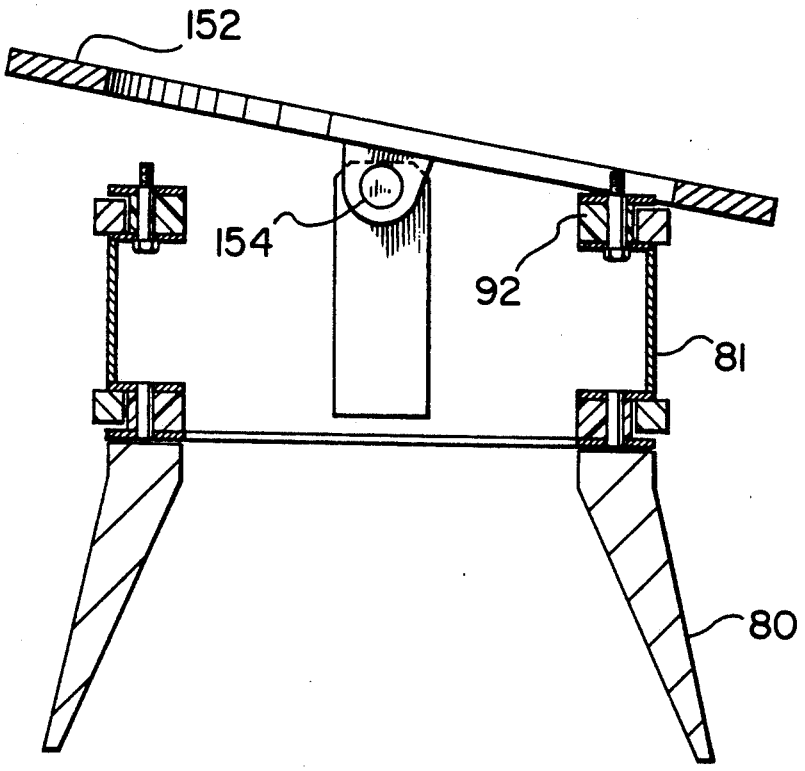
FIG. 16 is a side view of yet another embodiment of the shroud structure.

FIG. 16 illustrates a further modification to the shroud structure (parts have been removed for clarity). In this embodiment, in which similar elements are denoted by similar numerals from previous embodiments, there is provided a shroud structure particularly well adapted for drilling surfaces with irregular topography.

The structure provides a pivotal mounting member 152 in the example, illustrated as a ring, to which is pivotally mounted via hinge 154, shroud housing 81. In this arrangement, the shroud housing 81, shroud 80 and sealing member 92 as well as drilling means (not shown) extending therethrough are maintained in an aligned relationship.

In a further embodiment, the shroud housing, and more particularly the metal plate 104, may be mounted to housing 81 such that the housing is capable of pivotal motion relative to a vertical axis to thereby assist in single and convenient repositioning of the shroud.

It will be appreciated that the methods and apparatus of the present invention can be applied to a diverse scope of applications. Once such application can be seen in mining ore.

In conventional methods known in the art, a vertical mine shaft is drilled or blasted followed by the drilling of horizontal shafts off the main vertical shaft. One can see that in such a process the daily costs of operation would accrue rapidly, particularly if an ore source is not uncovered or cannot be "cost effectively" reached. Applicant, with the underground drilling method of the present invention, clearly obviates such difficulties. Using Applicant's methods, one need only bore holes selectively within an underground area to more efficiently and economically uncover an ore source which was previously unreachable using known technology in the art.

Although specific apparatus has been described herein, any mining apparatus may be used in the system herein described. Additionally, in a large mining operation, several centrifugal filters may be employed depending on requirement.

As those skilled in the art will realize, these preferred illustrated details can be subjected to substantial variation, without affecting the function of the illustrated embodiments. Although embodiments of the invention have been described above, it is not limited thereto and it will be apparent to those skilled in the art that numerous modification form part of the present invention insofar as they do not depart from the spirit, nature and scope of the claimed and described invention.

I claim:

1. A debris collection assembly comprising in combination: a cyclonic filter structure having an inlet and an outlet for discharging debris produced during a drilling procedure and a drop cone assembly having:

a tubular body having a first open end connected to said outlet of said filter structure and a second open end adapted for insertion within a debris receiving opening;

a hollow and resilient debris retaining member having an open first end and an open second end, said debris retaining member being positioned within said tubular body adjacent said first end, said second end of said debris retaining member self sealing under said vacuum for retaining a predetermined mass of debris and capable of opening when said predetermine mass is exceeded to thereby discharge said predetermined mass through said bore hole.

2. The drop cone assembly as set forth in claim 1, said retaining member is mounted within said tubular body in a coaxial relationship therewith.

3. The drop cone assembly as set forth in claim 2, wherein said debris retaining member is an inverted hollow cone shaped member.

4. The drop cone assembly as set forth in claim 3, wherein at least a portion of said tubular body comprises a resilient material.

5. The drop cone assembly as set forth in claim 3, wherein said debris retaining member comprises a resilient material.

6. The drop cone assembly as set forth in claim 3, wherein at least a vertex portion of said cone shaped member is self closing under vacuum conditions.

7. The drop cone assembly as set forth in claim 4, wherein tubular body includes a rigid tubular extension for insertion within a debris receiving opening.

8. The drop cone assembly as set forth in claim 7, said extension including means for mounting said debris retaining member to said cyclonic filter structure.

9. The drop cone assembly as set forth in claim 8, said extension further including means for connection ancillary equipment to said debris retaining member.

10. The drop cone assembly as set forth in claim 9, said ancillary equipment including fluid supply conduits.

* * * * *